US007490383B1

(12) United States Patent
Dean

(10) Patent No.: US 7,490,383 B1
(45) Date of Patent: Feb. 17, 2009

(54) CLEANING SYSTEM

(76) Inventor: Vicki J. Dean, 1042 N. Bogle Ave., Chandler, AZ (US) 85225

( * ) Notice: Subject to any disclaimer, the term of this patent is extended or adjusted under 35 U.S.C. 154(b) by 0 days.

(21) Appl. No.: 11/834,889

(22) Filed: Aug. 7, 2007

(51) Int. Cl.

| | |
|---|---|
| ***A46B 15/00*** | (2006.01) |
| ***A46B 9/02*** | (2006.01) |
| ***A47L 13/11*** | (2006.01) |
| ***A47L 13/16*** | (2006.01) |
| ***A47L 13/38*** | (2006.01) |

(52) U.S. Cl. ..... 15/145; 15/144.3; 15/160; 15/176.1; 15/234; 15/244.1; 15/245; 15/DIG. 5; 15/159.1; D4/132; D32/41; D32/50; D32/51

(58) Field of Classification Search ..... 15/144.3, 15/144.4, 145, 146, 148, 159.1, 160, 176.1–176.6, 15/234, 244.1, 245, DIG. 5; D4/130, 132–135; D32/35, 40, 41, 50, 51
See application file for complete search history.

(56) References Cited

U.S. PATENT DOCUMENTS

| | | | | | |
|---|---|---|---|---|---|
| 303,742 | A | | 8/1884 | Mills | |
| 843,590 | A | * | 2/1907 | Dunn et al. | 15/144.4 |
| 2,538,654 | A | * | 1/1951 | Petersen | 403/381 |
| 2,697,642 | A | | 12/1954 | Rudy | |
| 2,736,051 | A | * | 2/1956 | Boodakian | 15/160 |
| 2,824,323 | A | * | 2/1958 | Tos et al. | 15/105 |
| 2,993,222 | A | * | 7/1961 | Laymon | 15/234 |
| 3,038,188 | A | * | 6/1962 | Rebernak | 15/119.2 |
| 3,315,296 | A | * | 4/1967 | Richardson | 15/159.1 |
| 3,407,424 | A | * | 10/1968 | Lanzarone et al. | 15/145 |
| 3,600,740 | A | | 8/1971 | Ogler | |
| 4,020,521 | A | * | 5/1977 | Velasquez | 15/172 |
| 4,082,186 | A | * | 4/1978 | Chirumbolo | 206/577 |
| 4,130,912 | A | * | 12/1978 | Sheppard et al. | 15/210.1 |
| 5,464,481 | A | * | 11/1995 | Lietz et al. | 134/6 |
| 5,507,063 | A | * | 4/1996 | Hirsch | 15/160 |
| 5,575,032 | A | * | 11/1996 | Cernuska | 15/119.2 |
| D411,920 | S | | 7/1999 | Vosbikian et al. | |
| 5,924,157 | A | | 7/1999 | Barela | |
| 5,937,471 | A | | 8/1999 | Liao | |
| 6,155,620 | A | | 12/2000 | Armstrong | |
| 6,240,590 | B1 | * | 6/2001 | Nesbit | 15/210.1 |
| 6,336,241 | B1 | * | 1/2002 | Wilson | 15/144.2 |
| 6,823,555 | B2 | * | 11/2004 | Warren | 15/176.2 |

FOREIGN PATENT DOCUMENTS

| | | | |
|---|---|---|---|
| WO | 2005/055761 | * | 6/2005 |

* cited by examiner

*Primary Examiner*—Mark Spisich

(57) ABSTRACT

A cleaning system for cleaning articles along the floor to inhibit a person from having to bend over to clean the article includes a handle being graspable by a person. A plurality of cleaning heads is included. One of the cleaning heads is mountable to the handle. Each of the cleaning heads comprising a base section and a cleaning section. The base section is mountable to the handle. The cleaning section is coupled to and extends outwardly from the base section. The cleaning section is abutted and moved along an article to clean the article.

10 Claims, 6 Drawing Sheets

CLEANING SYSTEM

BACKGROUND OF THE INVENTION

1. Field of the Invention

The present invention relates to floor cleaning devices and more particularly pertains to a new floor cleaning device for cleaning articles along the floor to inhibit a person from having to bend over to clean the article.

2. Description of the Prior Art

The use of floor cleaning devices is known in the prior art. While these devices fulfill their respective, particular objectives and requirements, the need remains for a system that has certain improved features to allow the system to clean baseboards and other articles along the floor without having to bend over to clean. Additionally, the system should include a plurality of cleaning heads to allow a variety of articles to be cleaned.

SUMMARY OF THE INVENTION

The present invention meets the needs presented above by generally comprising a handle being graspable by a person. A plurality of cleaning heads is provided. One of the cleaning heads is mountable to the handle. Each of the cleaning heads comprising a base section and a cleaning section. The base section is mountable to the handle. The cleaning section is coupled to and extends outwardly from the base section. The cleaning section is abutted and moved along an article to clean the article.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
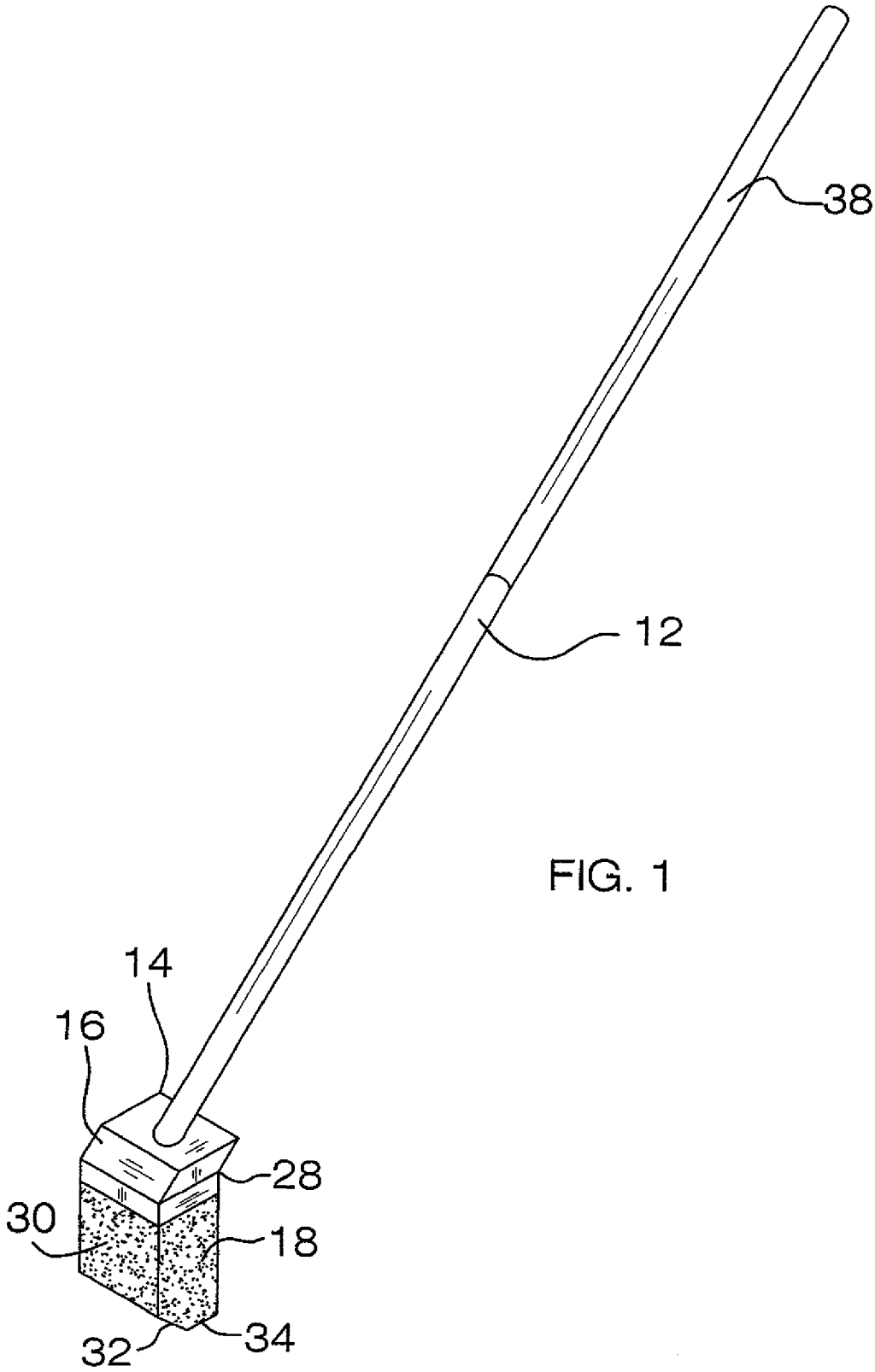
FIG. 1 is a perspective view of a scrubbing head of a cleaning system according to the present invention.
Figure 2:
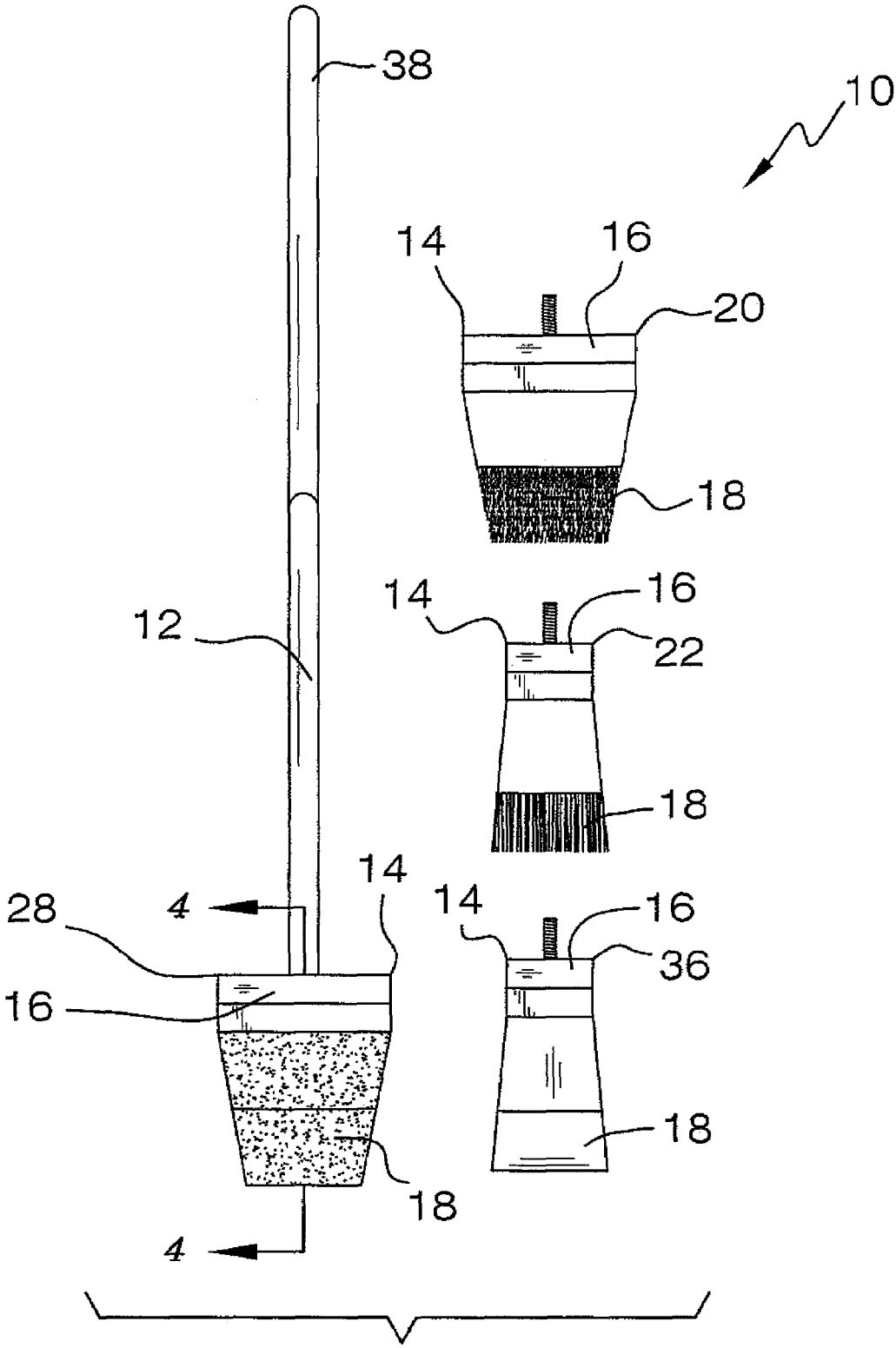
FIG. 2 is a front exploded view of the present invention.
Figure 3:
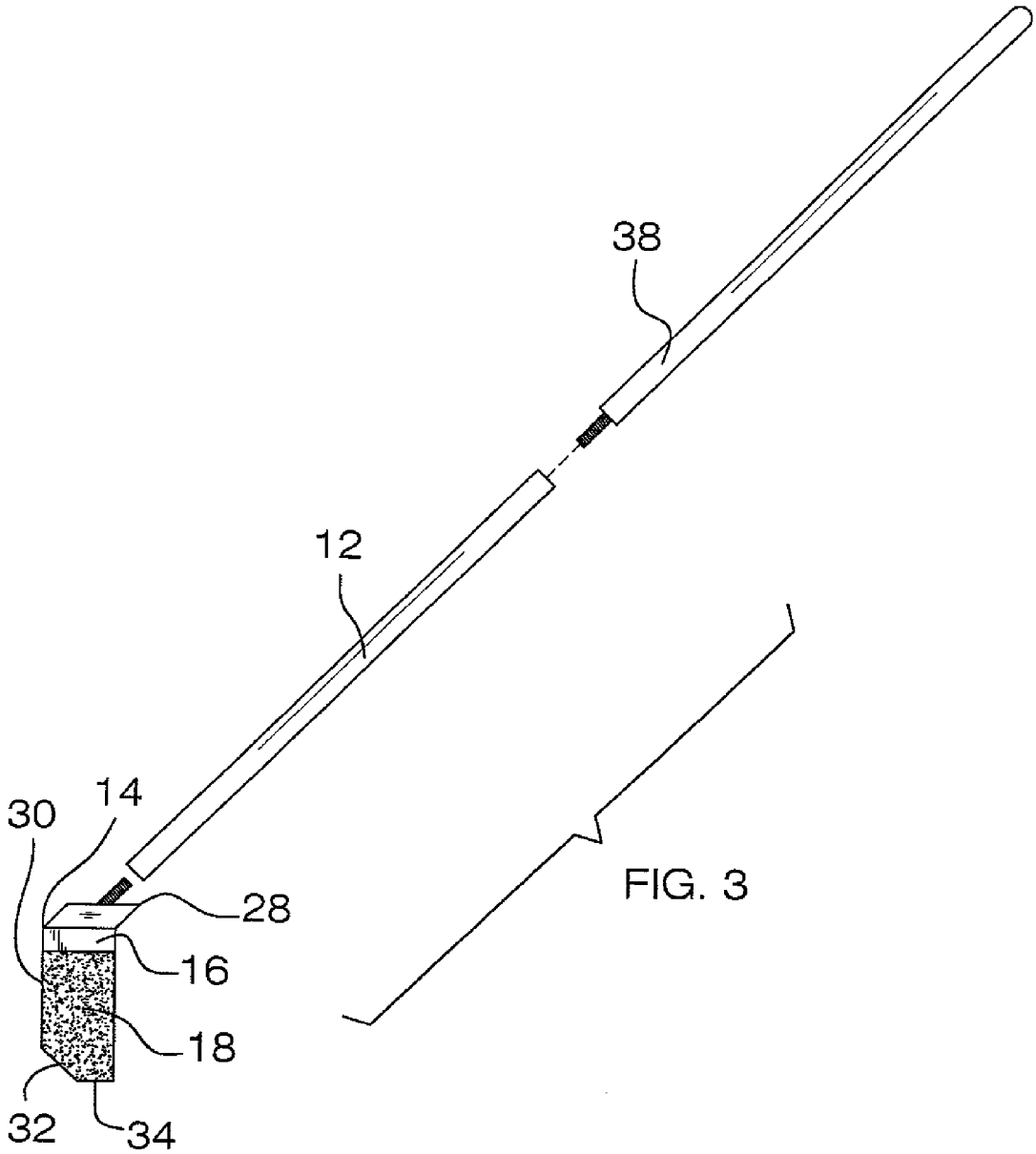
FIG. 3 is an exploded side view of the present invention shown in FIG. 1.
Figure 4:
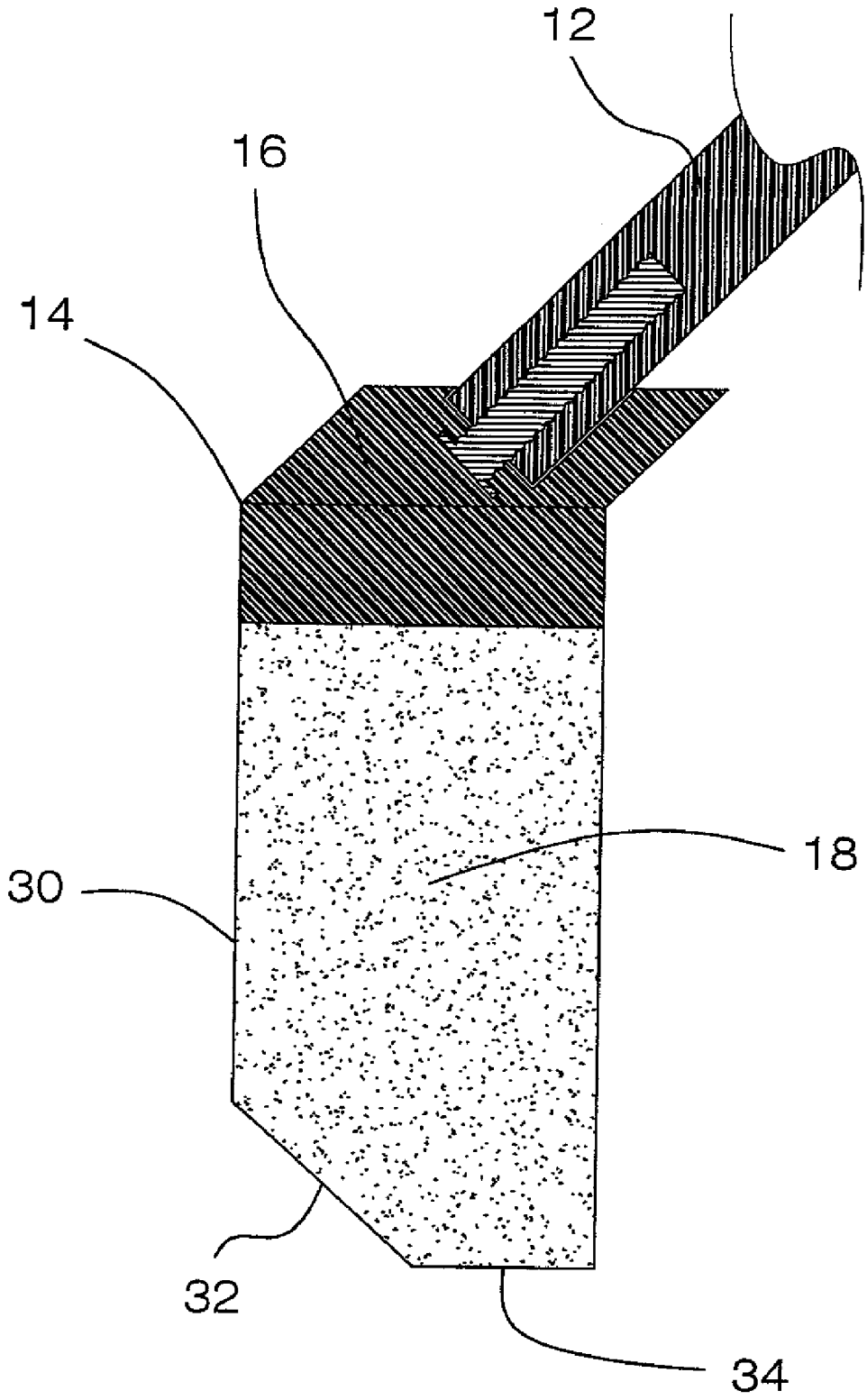
FIG. 4 is a cross-sectional view of the present invention taken along line 4-4 of FIG. 2.
Figure 5:
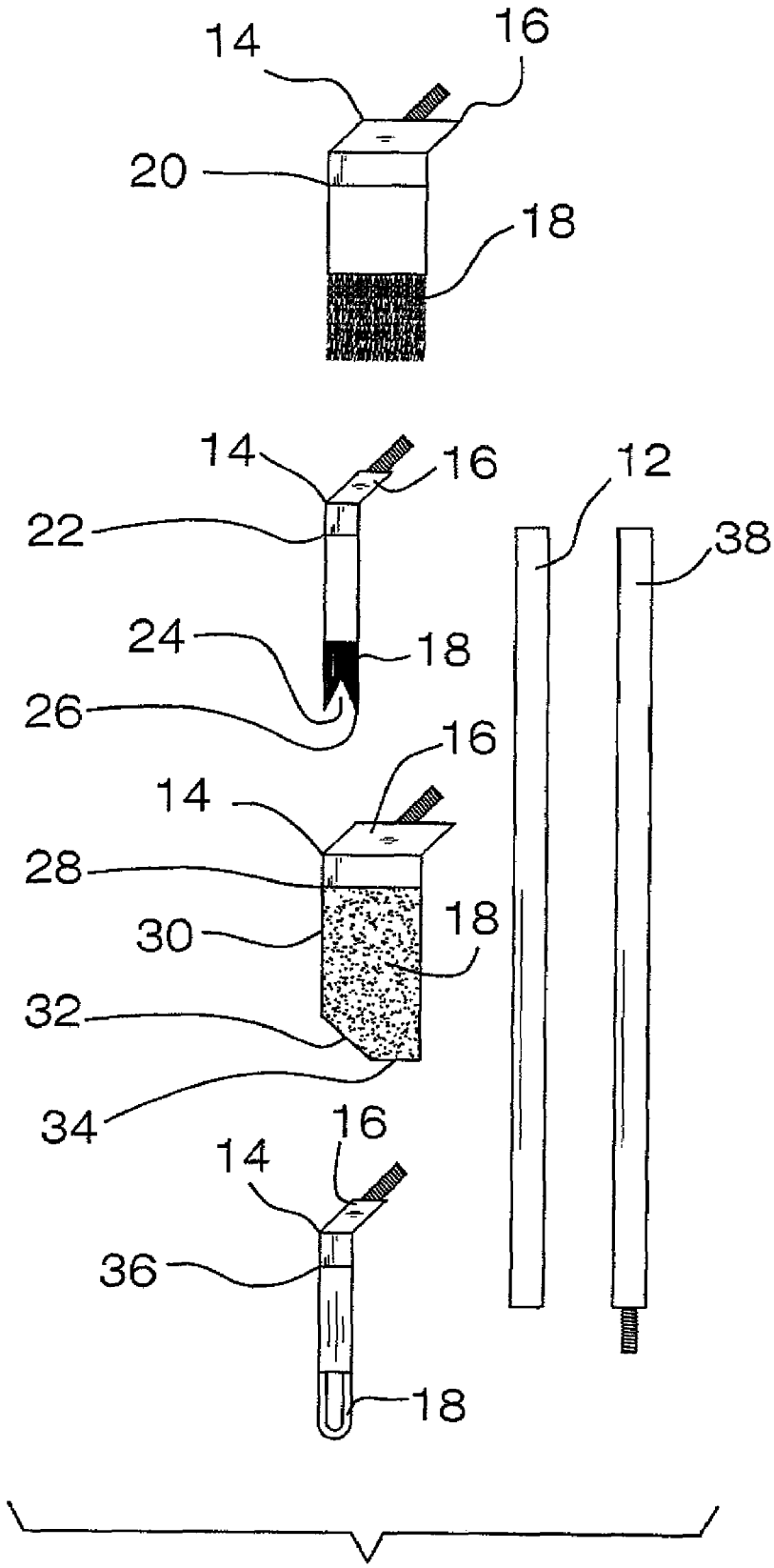
FIG. 5 is an exploded side view of the present invention shown in FIG. 2.
Figure 6:
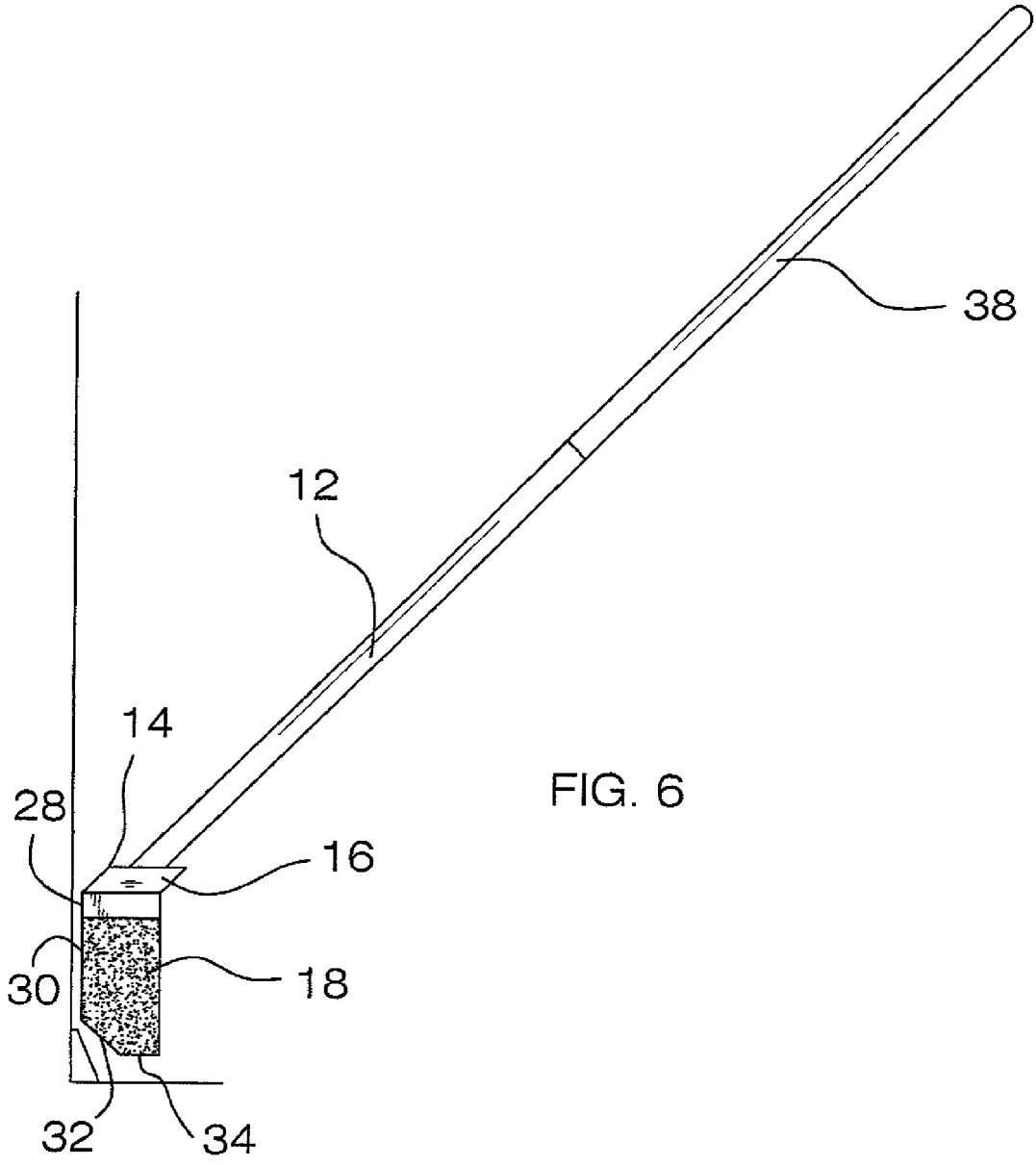
FIG. 6 is a side view of the present invention shown in FIG. 1 in use.

With reference now to the drawings, and in particular to FIGS. 1 through 6 thereof, a new floor cleaning device embodying the principles and concepts of the present invention and generally designated by the reference numeral 10 will be described.

As best illustrated in FIGS. 1 through 6, the cleaning system 10 generally comprises a handle 12 being graspable by a person. The handle 12 has a length of approximately 2 feet. One of a plurality of cleaning heads 14 is mountable to the handle 12. Each of the cleaning heads 14 comprises a base section 16 and a cleaning section 18. The base section 16 is mountable to the handle 12. The cleaning section 18 is coupled to and extends outwardly from the base section 16. The cleaning section 18 is abutted and moved along an article to clean the article. The cleaning section 18 extends at an angle from the handle 12 between approximately 40 degrees and approximately 50 degrees.

The plurality of cleaning heads 14 includes a dusting head 20. The cleaning section 18 of the dusting head 20 comprises a plurality of feathers. The feathers dust the article when the dusting head 20 is moved along the article. The dusting head 20 has a length of approximately 4 inches and a width of approximately 3 inches.

The plurality of cleaning heads 14 includes a brushing head 22. The cleaning section 18 of the brushing head 22 is comprised of bristles. The bristles sweep dirt from the article when the brushing head 22 is moved along the article. The brushing head 22 has a channel 24 extending into the cleaning section 18 of the brushing head 22 through a lower face 26 of the brushing head 22. The channel 24 extends along a length of the brushing head 22. The channel 24 receives a section of the article to allow the bristles to extend around the section of the article. The brushing head 22 has a length of approximately 4 inches and a width of approximately 1 inch.

The plurality of cleaning heads 14 includes a scrubbing head 28. The cleaning section 18 of the scrubbing head 28 is comprised of a sponge. The cleaning section 18 absorbs a liquid to clean the article when the scrubbing head 28 is moved along the article. The cleaning section 18 of the scrubbing head 28 includes a front face 30, a bottom face 34 and an angled face 32 that extends between the front face 30 and the bottom face 34 to better conform to the article being cleaned. The scrubbing head 28 has a length of approximately 4 inches and a width of approximately 3 inches.

The plurality of cleaning heads 14 includes a squeegeeing head 36. The cleaning section 18 of the squeegeeing head 36 is comprised of an elastomeric straight edge. The cleaning section 18 of the squeegeeing head 36 wipes liquid from a surface of the article when the squeegeeing head 36 is moved along the surface of the article. The squeegeeing head 36 has a length of approximately 4 inches and a width of approximately 1 inch.

An extension rod 38 is couplable to the handle 12 opposite one of the cleaning heads 14 mounted to the handle 12. The extension rod 38 is graspable to extend a reach of the one of the cleaning heads 14 from the person grasping the extension rod 38. The extension rod 38 has a length of approximately 2 feet.

In use, one of the cleaning heads 14 is mounted to the handle 12. The handle 12 is then grasped by a person. The handle 12 is manipulated to direct the associated one of the cleaning heads 14 against the article and moved along the article to clean the article.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning system comprising:

an elongated handle being graspable by a person;

a plurality of cleaning heads, each of said cleaning heads being selectively mountable to said handle, each of said cleaning heads comprising a base section and a cleaning section, said base section being mountable to said handle, said cleaning section being coupled to and extending outwardly from said base section, said cleaning section being abutted and moved along an article to clean the article, wherein said cleaning section extends at an angle from said handle between approximately 40 degrees and approximately 50 degrees; and said plurality of cleaning heads including a brushing head, said cleaning section of said brushing head being comprised of bristles, said bristles sweeping dirt from the article when said brushing head is moved along the article, the free ends of the bristles defining a brushing surface at a lower face of the brushing head and wherein the brushing surface is generally rectangular with the length thereof oriented transverse with respect to the longitudinal axis of the handle and lateral edges of the brushing head being oriented on opposite sides of the axis of the handle, said brushing head having a channel extending into said cleaning section of said brushing head through the lower face of said brushing head, said channel extending along the entire length of said brushing surface and through the lateral edges thereof, and wherein the channel extends along an axis transverse to the axis of the handle.

2. The system according to claim 1, wherein said plurality of cleaning heads includes a dusting head.

3. The system according to claim 2, wherein said cleaning section of said dusting head comprising a plurality of feathers, said feathers dusting the article when said dusting head is moved along the article.

4. The system according to claim 1, wherein said plurality of cleaning heads includes a scrubbing head.

5. The system according to claim 4 wherein said cleaning section of said scrubbing head is comprised of a sponge, said cleaning section absorbing a liquid to clean the article when said scrubbing head is moved along the article.

6. The system according to claim 5 wherein said cleaning section of said scrubbing head includes a front face, a bottom face and an angled face extending between said front face and said bottom face to better conform to the article being cleaned.

7. The system according to claim 1, wherein said plurality of cleaning heads includes a squeegeeing head.

8. The system according to claim 7, wherein said cleaning section of said squeegeeing head is comprised of an elastomeric straight edge, said cleaning section of said squeegeeing head wiping liquid from a surface of the article when said squeegeeing head is moved along the surface of the article.

9. The system according to claim 1, further comprising an extension rod being couplable to said handle opposite one of said cleaning heads mounted to said handle, said extension rod being graspable to extend a reach of the one of said cleaning heads from the person grasping said extension rod.

10. A cleaning system comprising:

an elongated handle being graspable by a person;

a plurality of cleaning heads, each of said cleaning heads being selectively mountable to said handle, each of said cleaning heads comprising a base section and a cleaning section, said base section being mountable to said handle, said cleaning section being coupled to and extending outwardly from said base section, said cleaning section being abutted and moved along an article to clean the article, said cleaning section extending at an angle from said handle between approximately 40 degrees and approximately 50 degrees;

said plurality of cleaning heads including a dusting head, said cleaning section of said dusting head comprising a plurality of feathers, said feathers dusting the article when said dusting head is moved along the article;

said plurality of cleaning heads including a brushing head, said cleaning section of said brushing head being comprised of bristles, said bristles sweeping dirt from the article when said brushing head is moved along the article, the free ends of the bristles defining a brushing surface at a lower face of the brushing head and wherein the brushing surface is generally rectangular with the length thereof oriented transverse with respect to the longitudinal axis of the handle and lateral edges of the brushing head being oriented on opposite sides of the axis of the handle, said brushing head having a channel extending into said cleaning section of said brushing head through the lower face of said brushing head, said channel extending along the entire length of said brushing surface, said channel extending through the lateral edges thereof, and wherein the channel extends along an axis transverse to the axis of the handle;

said plurality of cleaning heads including a scrubbing head, said cleaning section of said scrubbing head being comprised of a sponge, said cleaning section absorbing a liquid to clean the article when said scrubbing head is moved along the article, said cleaning section of said scrubbing head including a front face, a bottom face and an angled face extending between said front face and said bottom face to better conform to the article being cleaned;

said plurality of cleaning heads including a squeegeeing head, said cleaning section of said squeegeeing head being comprised of an elastomeric straight edge, said cleaning section of said squeegeeing head wiping liquid from a surface of the article when said squeegeeing head is moved along the surface of the article; and an extension rod being couplable to said handle opposite one of said cleaning heads mounted to said handle, said extension rod being graspable to extend a reach of the one of said cleaning heads from the person grasping said extension rod.

* * * * *